US006502587B1

(12) United States Patent
Kellum et al.

(10) Patent No.: US 6,502,587 B1
(45) Date of Patent: Jan. 7, 2003

(54) KIT WITH ILLUMINATED TWEEZERS AND MAGNIFYING MIRROR

(76) Inventors: Jane Kellum, 1102 Brook Hill Rd., McKinney, TX (US) 75070; Lynn A. Wengert, 2725 Fountain Head Dr., Plano, TX (US) 75023

( * ) Notice: Subject to any disclaimer, the term of this patent is extended or adjusted under 35 U.S.C. 154(b) by 100 days.

(21) Appl. No.: 09/616,693

(22) Filed: Jul. 14, 2000

(51) Int. Cl.[7] ..... A45D 42/02

(52) U.S. Cl. ..... 132/301; 132/288; 294/99.2; 362/119; 362/198

(58) Field of Search ..... 132/286, 288, 132/294, 296, 297, 301, 304, 315; D28/55, 64.1, 78; 294/99.1, 99.2; 359/879, 880, 871, 882, 838, 875, 840; 362/109, 119, 120, 197, 198, 135, 136, 138, 139, 257, 154, 156; 433/30, 31; 406/210, 211, 133

(56) References Cited

U.S. PATENT DOCUMENTS

| | | | | | |
|---|---|---|---|---|---|
| 718,748 | A | | 1/1903 | Boehm | |
| 1,516,955 | A | | 11/1924 | Cushimano | |
| 1,765,366 | A | | 6/1930 | Crater | |
| 1,842,403 | A | | 1/1932 | Hunsaker et al. | |
| 2,376,448 | A | | 5/1945 | Neugass | |
| 2,387,054 | A | | 10/1945 | Brustolon | |
| 2,666,843 | A | | 1/1954 | Zuckerman | |
| 2,943,184 | A | | 6/1960 | Christopherson | |
| 3,287,547 | A | * | 11/1966 | Spedding | 362/119 |
| 3,510,204 | A | | 5/1970 | Jack | |
| 3,709,235 | A | * | 1/1973 | Washburn et al. | 132/80 R |
| 3,714,411 | A | * | 1/1973 | Waters et al. | 240/6.45 |
| D253,974 | S | * | 1/1980 | Nalbandian | D28/55 |
| 4,524,647 | A | | 6/1985 | Holoff et al. | |
| 4,716,915 | A | * | 1/1988 | Burns | 132/286 |
| 4,779,753 | A | * | 10/1988 | Capy | 220/23 |
| 4,836,596 | A | | 6/1989 | Owen | |
| D305,697 | S | * | 1/1990 | Tarlow et al. | D28/64.3 |
| 5,025,354 | A | * | 6/1991 | Kondo | 362/135 |

(List continued on next page.)

OTHER PUBLICATIONS

Copy of web pages from Lucid products; URL: *www.lucid-products.com*; "TWEEZ–EEZ™".

*Primary Examiner*—Nicholas D. Lucchesi
*Assistant Examiner*—David C. Comstock
(74) *Attorney, Agent, or Firm*—Rick Matos; Innovar, L.L.C

(57) ABSTRACT

Illuminated tweezers with flexible extension and magnifying mirror (10) utilized for the extraction of unwanted facial hair. The present hair removal device includes a housing (12) encasing a battery or other electrical source and being adapted to accommodate a folding, hinged mirror (26). The housing is coupled to an elongated flexible extension (14) having illuminated tweezers (40) at the distal end (18). A light source (38) is included in the base of the tweezers (40) such that it emits light toward the prongs of the tweezers (40). The housing (12) and the distal end (18) of the flexible extension (14) containing the illuminated tweezers (40) can each be positioned and oriented independently of one another allowing a single user to operate the device. The housing (12) is formed with a peripheral groove (22) for accommodating the flexible extension (14) and attached illuminated tweezers (40) so that the flexible extension (14) can be wrapped around the housing (12) for storage to provide a compact configuration for use. Another embodiment of the kit (45) includes a compact (47) having a lid (50), one or more magnifying mirrors (46), a body (51), illuminated tweezers (53), a receptacle (52) for the tweezers, one or more optional cosmetic reservoirs (55), one or more optional cosmetic applicators (77), one or more optional receptacles (76) for the one or more applicators, and an optional light source (60) in the compact. The tweezers can also be retractable with respect to the compact.

29 Claims, 7 Drawing Sheets

U.S. PATENT DOCUMENTS

| | | | | | |
|---|---|---|---|---|---|
| 5,263,754 | A | | 11/1993 | Coleman | |
| D343,027 | S | | 1/1994 | Coleman | |
| 5,358,297 | A | | 10/1994 | Coleman | |
| 5,374,274 | A | * | 12/1994 | Sproviero et al. | 606/131 |
| 5,528,470 | A | * | 6/1996 | White | 362/135 |
| 5,611,362 | A | * | 3/1997 | Duncan et al. | 132/301 |
| 5,655,553 | A | * | 8/1997 | Giese et al. | 132/303 |
| D404,532 | S | * | 1/1999 | Castagna | D28/77 |
| 5,983,905 | A | * | 11/1999 | Patching | 132/318 |
| D422,753 | S | * | 4/2000 | Einarson | D28/77 |
| 6,055,992 | A | * | 5/2000 | Skarne | 132/293 |
| 6,095,334 | A | * | 8/2000 | Belveal et al. | 206/581 |
| 6,189,542 | B1 | * | 2/2001 | Shepard | 132/273 |
| 6,227,208 | B1 | * | 5/2001 | Imbert | 132/304 |
| 6,325,077 | B1 | * | 12/2001 | Lark | 132/312 |

* cited by examiner

KIT WITH ILLUMINATED TWEEZERS AND MAGNIFYING MIRROR

FIELD OF INVENTION

This invention relates to a kit comprising illuminated tweezers in combination with a magnifying mirror for enhanced detection and extraction of unwanted chin, neck, and facial hair.

BACKGROUND OF THE INVENTION

Unwanted facial hair located on the chin or neck is a continuing problem for many people. Unwanted facial hair is generally quite small or light colored making it very difficult to see and remove. This may result in the need to recruit an individual to perform hair removal or in remaining personally ignorant of the existence of the unwanted facial hair while it is readily apparent to the casual observer.

Unwanted facial hair can also be detected at inopportune moments such as at a social gathering, business meeting, or while commuting to work. The short, bristly chin hair can be detected while feeling one's own chin and neck. While the location of the chin hair is readily apparent to one's own touch, it is quite difficult to visually locate and extract using currently available methods. This can cause much personal consternation when the chin hair can be felt, but not seen in order for the hair to be extracted. Awareness of the existence of the unwanted facial hair, while at the same time being unable to detect and extract it, can be very disturbing psychologically.

Another type of unwanted neck or chin hair is the long blond/gray variety. One might catch a quick glimpse of this long, blond/gray chin or neck hair in the rear view mirror of the car due to back lighting conditions that frequently occur. This type of hair is very difficult to detect visually with standard bathroom lighting and causes further frustration to one who is aware of the existence of chin hair but is unable to see it in order to extract it. Knowing that one has a chin hair makes the individual self-conscious and may consequently affect the person's self-esteem. Current societal mores do not include disclosing the existence of chin hair to another person. However, there are many who are unaware of their unwanted facial hair. While these people are unaware at the time, once these hairs are inadvertently discovered their first reaction is embarrassment.

Tweezers are used for cosmetic purposes, in particular for the removal of unwanted facial hair on the chin and neck while standing in front of a mirror with overhead or vanity lights. A drawback of conventional tweezing is that it is difficult to reach the desired area for hair removal while standing in front of a mirror. For example, the hair may be located on the side of the neck causing one to perform a variety of contortions to reach the offending hair. It may be physically impossible to remove the unwanted hair in this manner.

In all instances, there currently are no effective means to remove the unwanted hair without requiring the need of a separate magnifying glass or separate mirror, tweezers, and flashlight. Carrying conventional tweezers in a purse may on a fortuitous occasion solve the problem. However, the optimal circumstance of having a grooming device that incorporates all the necessary features (tweezers, illumination, magnification, and portability) for efficiently removing the unwanted facial hair is currently not available.

Hair removal with tweezers as described herein is less expensive than topical creams, waxing, electrolysis, or lasers, which may also have negative side effects. Additionally, hair extraction as described herein can be accomplished on an as-needed basis as opposed to the daily use of creams or weekly visits to the beauty salon.

U.S. Pat. No. 4,524,647 to Holoff discloses tweezers in combination with a light source and a magnifying lens. U.S. Pat. No. D253,974 to Nalbandian discloses illuminated tweezers with the light source emanating between the tweezers prongs. U.S. Pat. No. 5,358,297 to Coleman, U.S. Pat. No. 5,263,754 to Coleman, U.S. Pat. No. 3,744,883 to Williams and U.S. Pat. No. D343,027 to Coleman disclose tweezers in combination with a magnifying lens. Each of the prior art kits or systems requires an additional mirror in order to be used properly. Lucid Products currently sells illuminated tweezers called the TWEEZ-EEZ™.

The prior art discloses a number of different compacts which together can be described as comprising a body, a lid, an optional mirror (which can be magnifying or non-magnifying), one or more optional reservoirs of cosmetic, and one or more optional cosmetic applicators. None of the prior art discloses a compact having these above-noted features in combination with illuminated tweezers.

Accordingly, none of the prior art discloses a kit comprising illuminated tweezers in combination with a compact comprising one or more optional reservoirs of cosmetic, one or more optional cosmetic applicators, and one or more magnifying mirrors. Such a kit is preferred over known kits due to its versatility, ease of use and simplicity in design and manufacture.

SUMMARY OF THE INVENTION

The tweezers of the invention provide one or more of the following advantages:

a) Increased visibility and improved detection of unwanted facial and neck hairs.

b) Ease of operation in the extraction of chin and neck hair from one's own person without requiring the recruitment of another individual.

c) Greater convenience of use in that it can be used anywhere at anytime.

d) Compact construction and enhanced portability for carrying in a purse, pocket, or glove compartment.

e) Combination unitary construction precluding the need to locate separate tweezers, magnifying mirror, and appropriate light source;

f) Two-handed operation enables the user to hold this device in one hand and to easily manipulate the tweezers in the other;

g) Reduced stress and eased state of mind so that one no longer has to worry about having others spot these offending hairs;

h) Improved accessibility to the chin and neck hair thereby facilitating extraction and minimizing the need for physical contortions in order to be able to locate chin/neck hairs in order to extract them; and i) An inexpensive method for the extraction of unwanted facial hair that does not require daily treatment and that can be performed on an as-needed basis.

Accordingly, a first aspect of the invention provides a kit for removal of hair comprising:

illuminated tweezers;

a compact comprising a receptacle for the tweezers; and at least one magnifying mirror.

The compact can further comprise one or more reservoirs of cosmetic, which can be permanent or replaceable with respect to the compact. The mirror can be disposed within or outside the compact. Any known illuminated tweezer can be used in this kit. Any known compact can be modified according to the invention described herein to receive illuminated tweezers and one or more magnifying mirrors. Any known cosmetic and applicator can be used in the kit of the invention. The mirror or some part of the compact can also be illuminated.

A second aspect of the invention provides a combination tweezer apparatus comprising:

a pair of prongs together defining a hair grasping first end and joined second end;

a light source, adjacent the joined second end, which projects light toward the hair grasping first end;

a flexible extended member comprising a third end engaged with the joined second end and a fourth end; and a body engaged with the fourth end and comprising a magnifying mirror.

A third aspect of the invention provides a device for removing hair comprising, in a single unit:

a tweezers comprising a hair grasping end and a joined end;

a light source engaged with the tweezers to project light toward the hair-grasping end;

a flexible extended member engaged with the tweezers;

a body engaged with the flexible extended member; and a magnifying mirror engaged with the body.

Yet another embodiment of the invention provides a hair removal device comprising in a single unit:

a tweezers;

a light source engaged with the tweezers;

a flexible extended member engaged with the tweezers;

a body engaged with the flexible extended member and comprising a receiving area for the flexible extended member, a retainer for the tweezers, and a magnifying mirror.

BRIEF DESCRIPTION OF THE DRAWINGS

The following drawings form part of the present specification and are included to further demonstrate certain aspects of the invention. The invention may be better understood by reference to one or more of the drawings in combination with the description of the specific embodiment presented herein, wherein.

DETAILED DESCRIPTION OF THE INVENTION

Figure 1:
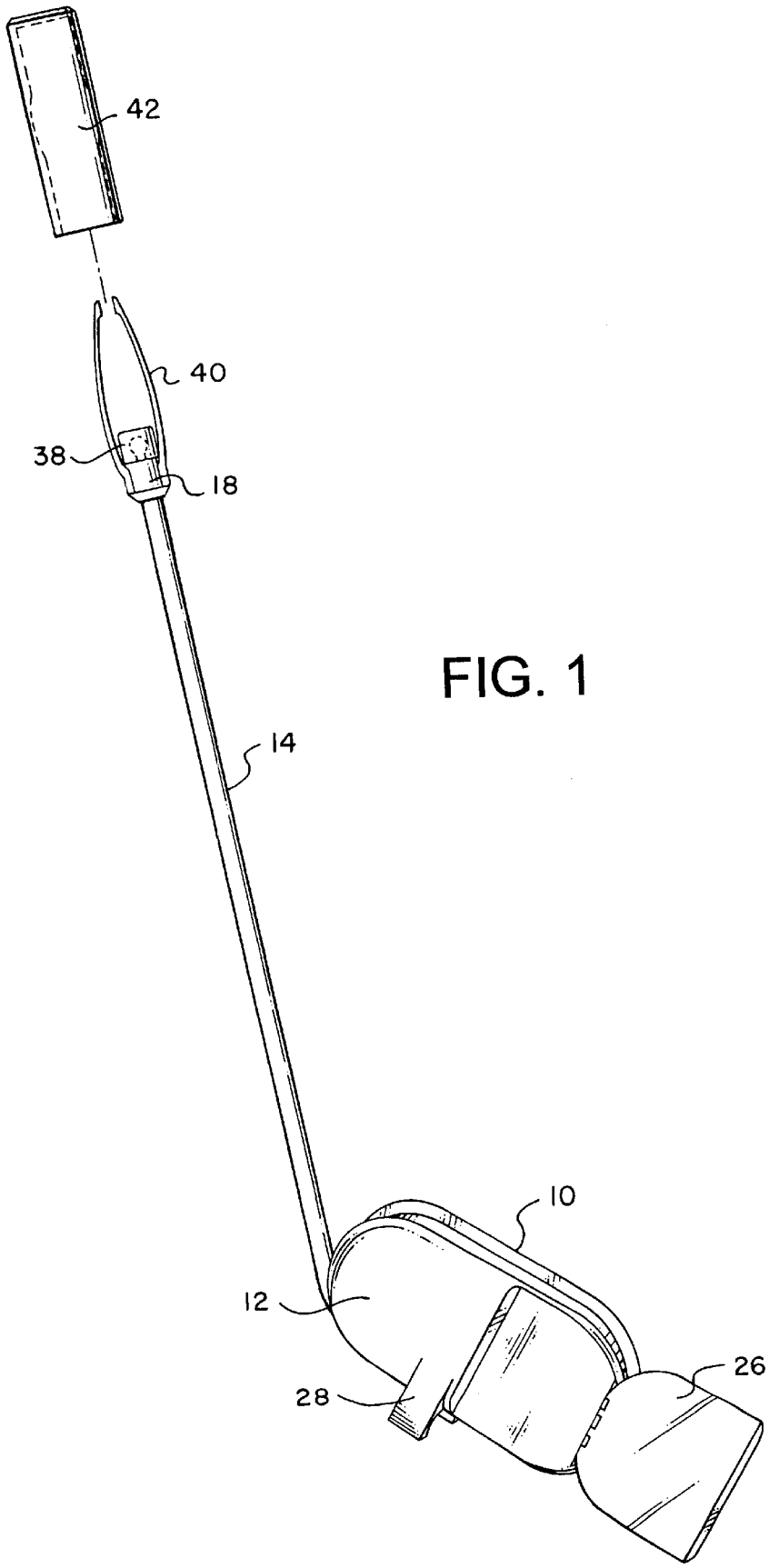
FIG. 1 is a front perspective view of a first embodiment of the invention wherein a tweezers is attached to a light source coupled to a flexible extension joined to a housing having a hingedly attached magnifying mirror in the open position.
Figure 2:
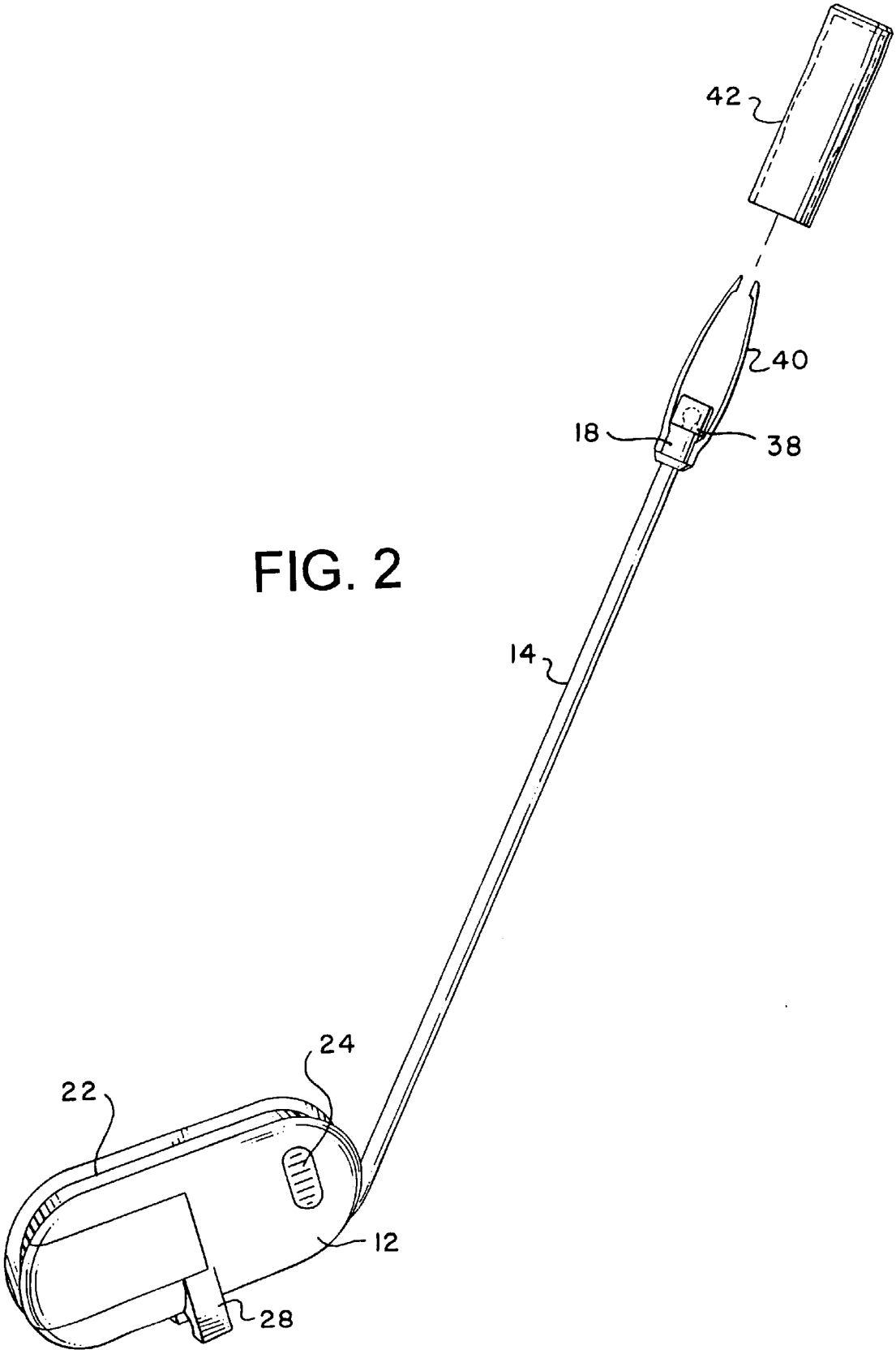
FIG. 2 is a rear perspective view of the device of FIG. 1.
Figure 3:
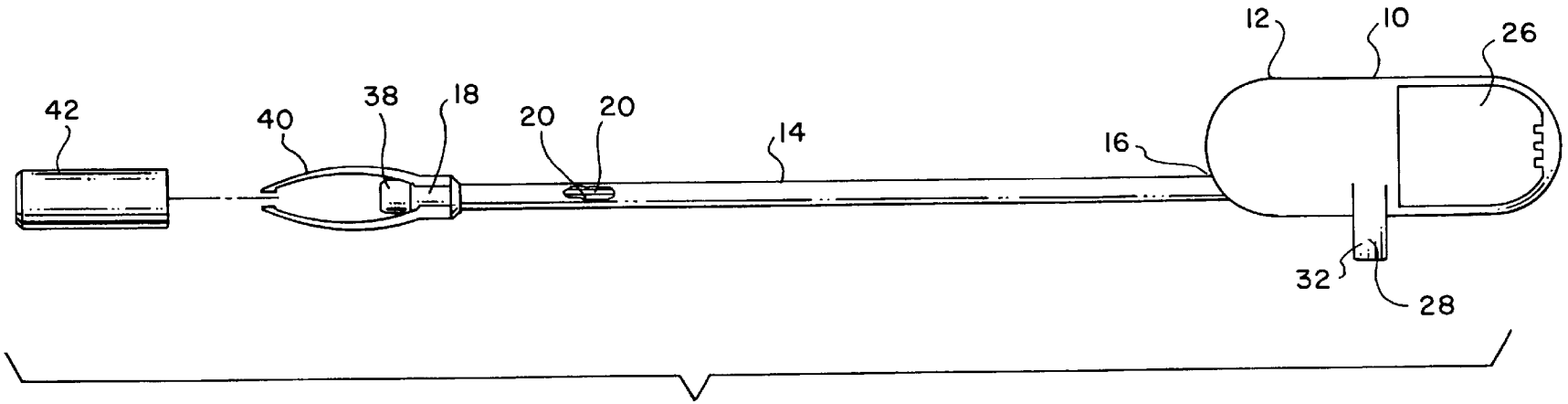
FIG. 3 is a left-side elevation view of the device of FIG. 1 showing the flexible extension in a long-reach configuration and the magnifying mirror in a closed position.
Figure 4:
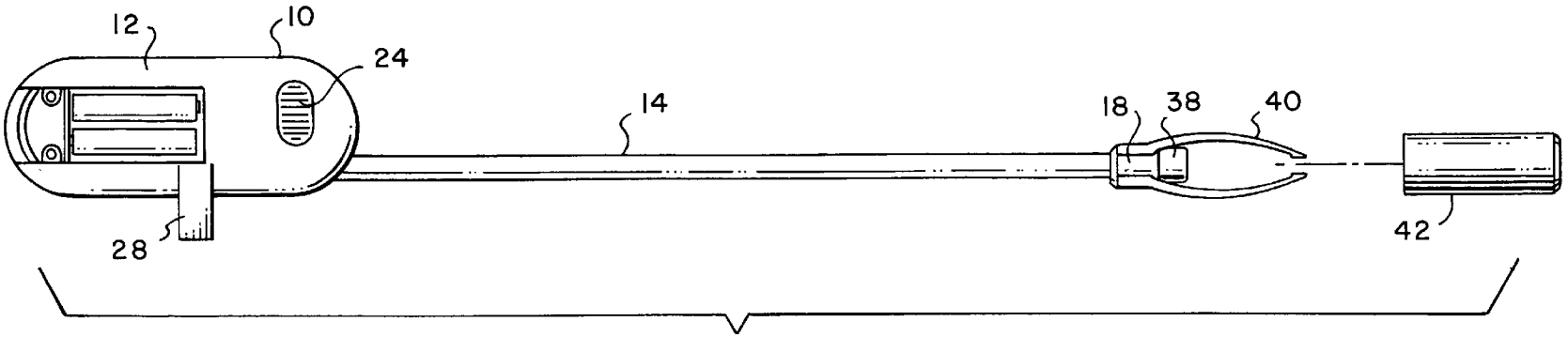
FIG. 4 is a right-side elevation view of the device of FIG. 1 having a battery cover removed.

FIGS. 1–7 depict illuminated tweezers with a flexible extension and magnifying mirror constructed in accordance with the invention. Tweezers 10 comprise a housing 12 and a flexible extension 14. Coupled to the housing 12 is a mirror 26 on one side, and a switch 24 on the other side for operating the light source 38. The housing 12 is adapted to hold one or more batteries (not shown), for example a pair of AAA batteries. The extension 14 has a proximal end 16 connected to the housing 12 and a distal end 18 opposite the proximal end 16. The conductive leads 20 carried by the extension 14 are adapted to connect the battery to a light source 38 positioned in the center of prongs 40. The extension 14 is formed in such a manner that it can be easily flexed by hand to assume a plurality of different shapes and retain a given shape indefinitely. Thus the housing 12 and the light source 38 can each be conveniently positioned and oriented independently of one another. Any of the known flexible extensions that temporarily retain a configuration on their own can be used in the present device. In addition, the flexible extension can be one or more strings, cables, ropes, straps, bands and/or wires which do not temporarily maintain a configuration on their own. The magnifying mirror could be attached directly to the flexible extension.

Figure 6:
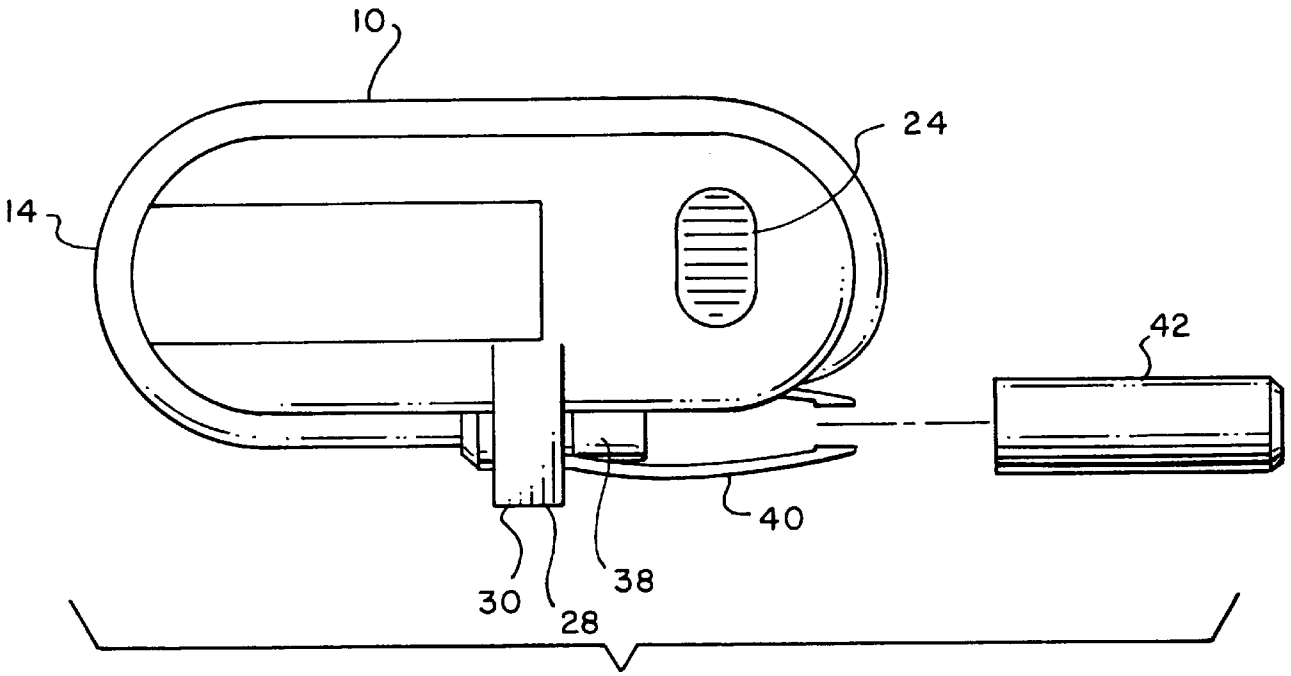
FIG. 6 is a right-side elevation view of the device of FIG. 1, wherein the extension is wrapped about the periphery of the housing.
Figure 7:
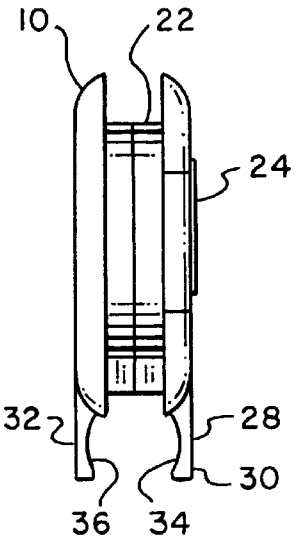
FIG. 7 is a rear elevation view of the device of FIG. 1 showing the retainer and the receiving area.

FIGS. 1–4 illustrate a first configuration or relative orientation of the housing 12 and the prongs 40. FIGS. 6–7 illustrate a second relative orientation. From these few examples, it is clear that the number of different possible relative orientations of the housing 12 and prongs 40 is essentially unlimited.

In the first configuration depicted in FIGS. 1–4, the tweezers 10 with the extension 14 can be used to locate and extract facial hairs that would be otherwise difficult to see and remove easily. A user may hold the tweezers 10 at a position considerably removed from the distal end 18 of the extension 14. Thus the tweezers 10 is capable of being positioned to readily locate and thereby remove facial hairs that may be inaccessible or difficult to detect utilizing direct lighting.

Figure 5:
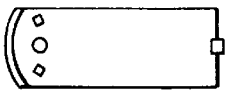
FIG. 5 is a plan view of the inside of the battery cover.

The flexibility of the extension 14 together with its optional ability to retain any shape enables it to function as a gooseneck, as illustrated for example in FIG. 1. The extension 14 can be oriented so that light is projected from the light source 38 in any direction to best illuminate errant facial hairs, and the prongs 40 can grasp the offending hair and extract it. The extension 14 allows the user to orient the light source 38 to focus on an area of the chin and neck not readily visible when viewed directly in a conventional mirror. The prongs 40 can be either slanted or flat at the tip. FIG. 5 shows a battery cover 44 that can be easily removed from the body (or housing) for insertion of batteries.

In the second configuration or relative orientation depicted in FIGS. 6–7, the extension 14 is coiled around the housing 12. The housing 12 is formed with a peripheral groove 22 (or receiving area) for accommodating the extension 14 so that it can be wrapped around the housing 12. This type of construction provides a compact configuration for use, especially when tweezers 10 are held in the palm of the hand. A retainer 28 comprising a pair of arms 30 and 32 is mounted on the housing 12 for engaging extension 14 when the extension is accommodated in the groove 22, thereby assisting in retaining the extension 14 in the groove 22. Tweezers 10 is more easily carried neatly in a purse, a carrying case, cosmetic bag, vanity drawer, or glove compartment of a car.

As depicted in FIG. 7, the arms 30 and 32 extend from opposite sides of housing 12 in opposed parallel relation, and the surface of each arm that faces the other arm is concave. Outer rolled edges 34 and 36 of arms 30 and 32 are separated by a distance slightly less than the diameter of the distal end 18 of the extension 14 so that, when the distal end 18 of the extension 14 is forced into the retainer 28, the arms 30 and 32 are first bent slightly away from each other. When the prongs 40 of the extension 14 are fully accommodated within the retainer 28, the arms 30 and 32 snap back substantially to their respective positions shown for example in FIG. 7, and the rolled edges 34 and 36 prevent the accidental dislodging of the extension 14, and a cap 42 covers the prongs 40 for added protective purposes. At the same time, the flexibility of the arms 30 and 32 enables the distal end 18 of extension 14 to be withdrawn from the retainer 28 by pulling the distal end 18 of the extension 14 away from the housing 12. Any of the many retainers known in the mechanical arts for retaining one object temporarily with another can be used in the device of the present invention.

The light source used in the present invention can be any known light source and includes, for example, a laser, LED, incandescent bulb, electroluminescent bulb or fluorescent bulb. By using the appropriate light source, it can also be made to emit any desired color of light. The preferred color of the light will optimize the illumination of the hair to be removed. Accordingly, different colors of light may be useful for different colors of hair and/or skin. Moreover, different colors of light may be useful according to the environment of use of the kit. For example, in a dark room, a bright yellow, white or blue light may be preferred; whereas in a lighted room, a red or infrared light might be preferred.

In U.S. Pat. No. 5,695,271, U.S. Pat. No. 5,369,556, U.S. Pat. No. 5,154,483, U.S. Pat. No. D418,239, U.S. Pat. No. D404,517, U.S. Pat. No. D397,468, U.S. Pat. No. D390,989, and U.S. Pat. No. D337,839, the entire disclosures of which are hereby incorporated by reference, Zeller discloses a variety of light sources that can be modified and used according to the invention described herein. The modified light sources would include a light source, one or more magnifying mirrors, body (or compact), an optional flexible extension member, and one or more optional cosmetic reservoirs.

The tweezers 10 are generally operated as follows. The tweezers 10 is opened from its compact form depicted in FIG. 6 by removing the extension 14 from the peripheral grooves 22 and the retainer arms 30 and 32. The optional cap 42 is removed from the prongs 40. The switch 24 then activates the light source 38 by way of the conductive leads 20. The hinged mirror 26 is opened. By holding the housing 12 and the mirror 26 in the palm of one hand, the user grasps and manipulates the prongs 40 and the light source 38 in the other hand. Once the light source 38 illuminates the unwanted hair, the prongs 40 is easily manipulated to grasp and extract the unwanted hair. The light emanating from light source 38 to the mirror 26 provides excellent illumination and magnification to the ends of the prongs 40 thereby greatly facilitating the use of the tweezers 10 in detecting and extracting the unwanted hair. The artisan of ordinary skill understands that the above-described steps can be performed in different sequences.

Figure 8:
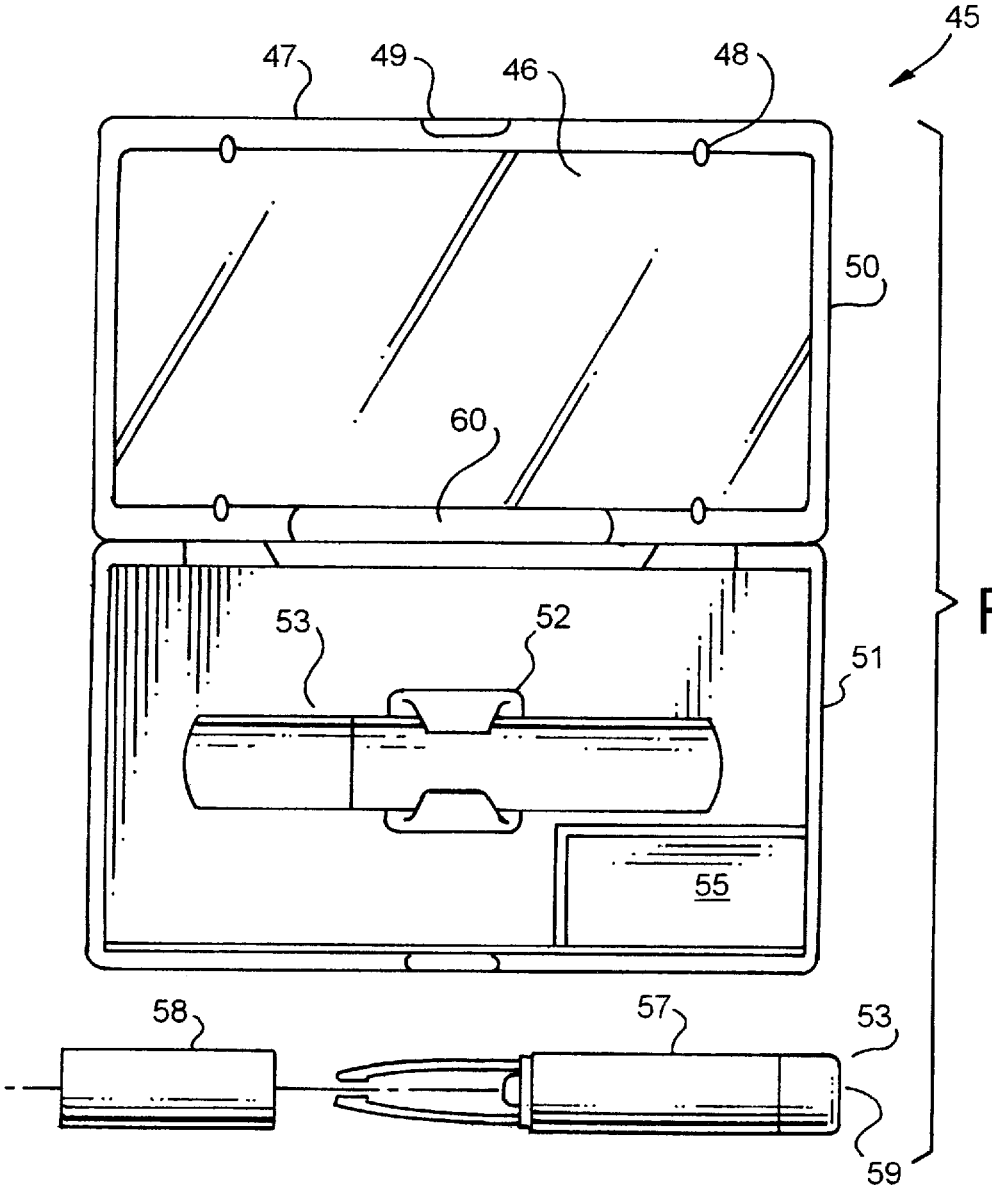
FIG. 8 is top plan view of a kit according to the invention.
Figure 10:
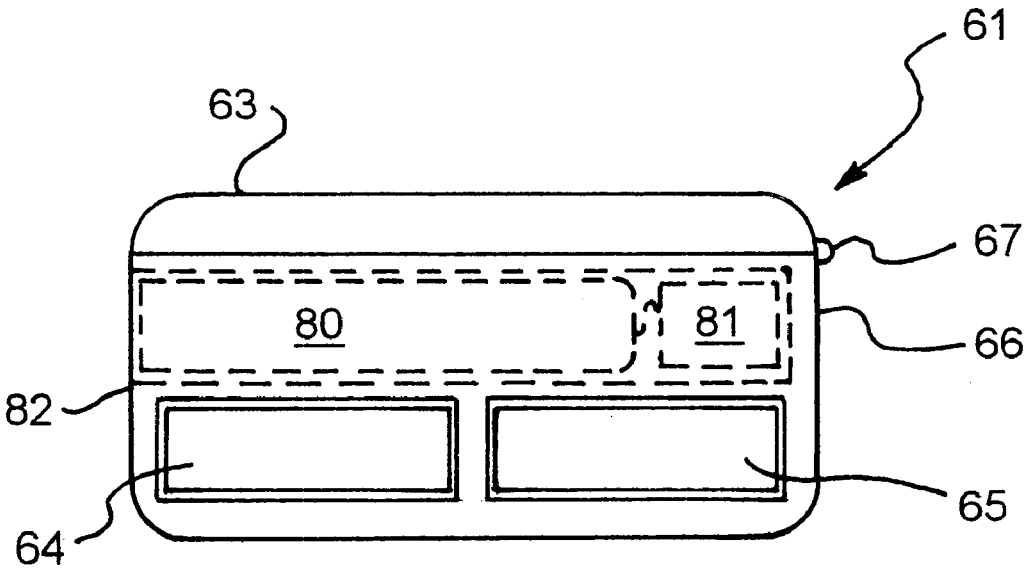
FIG. 10 is a side elevation view of another alternate embodiment of the kit according to the invention.
Figure 9:
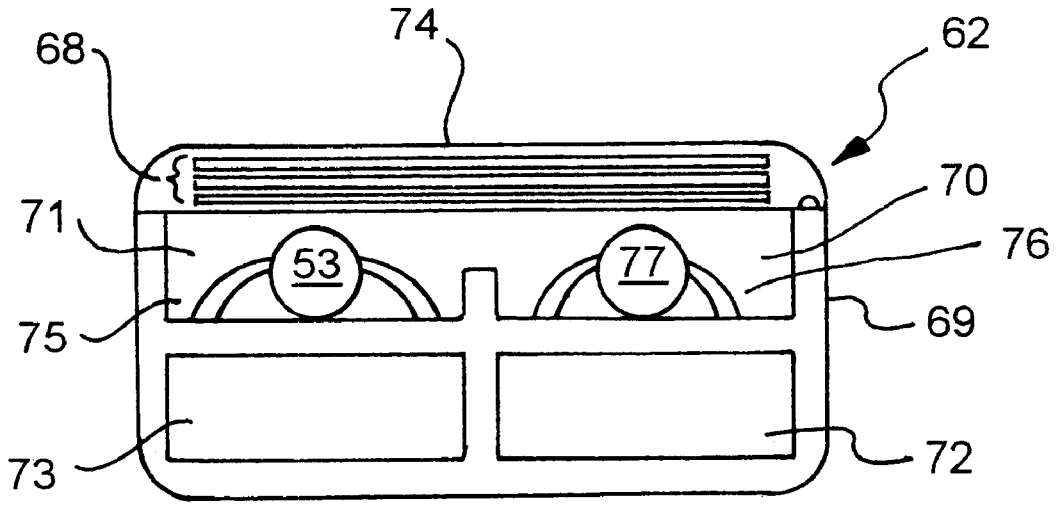
FIG. 9 is a side elevation view of alternate embodiment of the kit according to the invention.

FIGS. 8–10 depict three different embodiments of a kit according to the invention. The kit 45 depicted in FIG. 8 comprises a compact 47, comprising a lid 50 and a body 51, illuminated tweezers 53, a receptacle 52, one or more magnifying mirrors 46, and one or more optional reservoirs of cosmetic 55. The lid 50 includes an optional light source 60 which can also be used to illuminate skin from which hair is being removed. The mirror 46 is interchangeable and replaceable by way of plural tabs 48; accordingly, mirrors of different magnifications can be used with the compact. The tweezers 53 comprises a lid 58 and a body 57 having a battery reservoir 59 for placement of a permanent or removable battery (not shown). The tweezers 53 are removable from the receptacle 52.

FIG. 9 depicts a sectional side view of another kit according to the invention comprising a compact 62 comprising a lid 74 and a body 69. The lid 74 comprises three interchangeable magnifying mirrors 68 having magnifications of 2×, 5× and 10×. The mirrors are interchangeable by way of peripheral grooves in the lid. The body 69 comprises two receptacles 72, 73 for receiving removable and optionally interchangeable cosmetic reservoirs 64, 65. The body also comprises a tweezers 53 receiving area 71 and a cosmetic brush, pad, applicator or utensil 77 receiving area 70. Each receiving area preferably has a receptacle 75, 76, respectively, for retaining its respective item.

FIG. 10 depicts a side view of yet another kit according to the invention. The kit comprises a compact 61 comprising a lid 63 and a body 66. The body is hingedly 67 attached to the body. The body 66 comprises two cosmetic reservoirs 64, 65 which fit into respective receptacles in the body.

The flexible extension can be retractable into the housing by way of any conventional means of making extended flexible members (such as cord, string, wire, chain, strap or rope) retractacle from a housing. Exemplary retractacle member mechanisms include those used for spring-biased retractable key chains and those known by those of ordinary skill in the art. The compact 61 depicted in FIG. 10 depicts retractable illuminated tweezers 80 disposed in the receptacle 82. A retraction mechanism 81 disposed within the body of the compact 61 is engaged with the tweezers by way of a flexible thread, string, fiber, cord, wire or rope. Accordingly, the tweezers can be engaged with the receptacle of the compact by way of a sliding, snap-together, pressure-fit, or interlocking mechanism.

An alternate embodiment of the kit comprises a body, a hingedly attached magnifying mirror, a hingedly attached cover, a cosmetics reservoir and a receptacle in the body for receiving and retaining illuminated tweezers.

Any type of cosmetic typically found in a lady's cosmetic compact can be included in the kit of the invention. One or more reservoirs of cosmetics can be used in the compact.

Although the description above contains much specificity, these should not be construed as limiting the scope of the device but as merely providing illustrations of some of the presently preferred embodiments of this invention. The parts of the illuminated tweezers with flexible extension and magnifying mirror can be connected or associated with its adjacent elements in different manners. For example, all elements of this device such as the housing could be increased in size. The housing could be made of plastic and/or metal.

The magnifying mirror can be of varying powers of magnification, such as by making the mirror interchangeable. The mirror magnification could vary between 2× to 100× of normal size, or it could be 2×, 3×, 4×, 5×, 10× or other well known magnification. The mirror is made interchangeable by way of snap-fit, sliding, interlocking, interconnecting, or threaded connectors or any connectors known for interchangeably attaching one object onto another. Interchangeable mirrors or combination magnifying and non-magnifying mirrors are disclosed in the following patents. U.S. Pat. No. 5,950,640 to Duncan, discloses a compact with interchangeable non-magnifying and magnifying mirrors. U.S. Pat. No. 5,611,362 to Duncan discloses a compact with a top interior magnifying mirror and a lower a non-magnifying mirror. Any compact having a magnifying mirror can be made interchangeable according to the present invention. Exemplary compacts useful in the kit of the invention are disclosed in U.S. Pat. No. D543,117 to Kecman, U.S. Pat. No. 5,337,890 to Lai, U.S. Pat. No. 4,126,145 to Boyd, U.S. Pat. No. 3,714,411 to Waters, U.S. Pat. No. 4,936,324 to Chen, Des. U.S. Pat. No. 422,753 to Einarson, U.S. Pat. No. 5,163,457 to Lombardi, U.S. Pat. No. D275,713 to Bosworth, U.S. Pat. No. 3,860,015 to Tarro, U.S. Pat. No. 4,276,893 to Enomoto et al., U.S. Pat. No. D298,362 to Filiz et al., U.S. Pat. No. 4,343,397 to Nozawa et al., U.S. Pat. No. D381,124 to Blachut, U.S. Pat. No. D351,049 Schlueter, U.S. Pat. No. D324,587 to DiNuccio, U.S. Pat. No. D409,801 to Kim, U.S. Pat. No. D347,089 and U.S. Pat. No. D345,622 to Byars, et al., U.S. Pat. No. 5,054,505 to Vuharo, U.S. Pat. No. D344,817 to Chen, U.S. Pat. No. D349,977 to Shen, U.S. Pat. No. 5,605,167 to Montoli, U.S. Pat. No. D363,569 to Lai, U.S. Pat. No. D355,507 to Weiss, U.S. Pat. No. 373,221 to Lai, U.S. Pat. No. 5,655,553 to Giese et al., U.S. Pat. No. D353,023 and U.S. Pat. No. 355,730 to Chen, U.S. Pat. No. 398,706 to Epstein, and U.S. Pat. No. D331,818 Holahan et al.

When two or more magnifying mirrors are present, the mirrors can be disposed on opposite sides of the same substrate. For example, a 2× magnification mirror can be disposed on an opposite surface of glass bearing a 5× magnification mirror. Moreover, if two or more mirrors are present, one of the mirrors can be non-magnifying.

The magnifying mirror or compact can be illuminated according to methods well known in the art. U.S. Pat. No. 5,025,354 to Kondo, U.S. Pat. No. 5,528,470 to White, U.S. Pat. No. 5,832,941 to Murillo, U.S. Pat. No. D305,697 to Tarlow et al., U.S. Pat. No. D285,371 to Tong, U.S. Pat. No. D404,532 to Castagna, and U.S. Pat. No. 3,714,411 to Rosenberg et al. disclose illuminated compact and mirror combinations which can be used in the kit of the invention. The light emitted by the compact, mirror or tweezer can be any color. The preferred color light will optimize the visibility of hair being pulled by the tweezer.

The compact used in the kit of the invention can be any known compact which may or may not contain a cosmetic, and which can be modified according to the present invention to include a magnifying mirror, an illuminated tweezer and a receptacle for the tweezer. Suitable compacts which can be modified as needed are disclosed by U.S. Pat. No. 4,421,127 to Goer, U.S. Pat. No. 268,292 to Chevassus, U.S. Pat. No. 275,134 to Rosetti et al., U.S. Pat. No. D277,037 to Nadel, U.S. Pat. No. D290,761 to Goberman, U.S. Pat. No. D290,175 to Bakic, U.S. Pat. No. 5,878,878 to Wu, U.S. Pat. No. D411,648 Markham, U.S. Pat. No. D293,837 to Simonetti, U.S. Pat. No. 5,950,639 to Suzuki, U.S. Pat. No. 3,311,936 to Kingsford, U.S. Pat. No. 5,054,505 to Vuhars, U.S. Pat. No. 4,826,014 to Schefer, U.S. Pat. No. 6,047,710 to Irving et al., and U.S. Pat. No. 4,982,751 to Oishi, among others.

The housing of the compact can be any shape including, for example, circular, trapezoidal, rectangular, shell, or any shape known by the artisan of ordinary skill in the art. The housing and color of the light can be of different colors.

The entire disclosure, of each of the patents cited herein, is incorporated by reference.

Accordingly, the reader will understand that the illuminated tweezers with flexible extension and magnifying mirror is easily used to detect and extract unwanted facial hair. Furthermore, the device of the invention may provide one or more of the following advantages.

- Increased visibility and therefore improved detection of unwanted chin, neck and facial hair, which is paramount to the removal process.
- Back-lighting for improved visibility of unwanted chin, neck and facial hair.
- Single person operation for the extraction of unwanted chin, neck and facial hairs by themselves without suffering the embarrassment of having to enlist the aid of a second person to assist in this private process.
- Convenience of use. Given the design, it can be used anywhere at any time which allows for extraction of these unwanted hairs even at the most inopportune times when they are detected.
- Compact construction and ready portability which allow the user to easily carry this device in a purse, pocket, or glove compartment.
- Single unit construction which precludes the need to carry or have available each separate item.
- Ease of use because it is hand held, lightweight, and portable thereby allowing it to be easily manipulated.
- Enhanced personal appearance and reduced stress due to the easy extraction of unwanted facial and neck hairs thereby easing a person's mind. There is no longer a need to be concerned with having others spot these offending hairs and also allows one to go about in public without this worry.
- Improved accessibility to chin and neck hair requiring extraction thereby precluding the need for physical contortions in order to be able to locate and extract chin and neck hairs.

The above is a detailed description of particular embodiments of the invention. The artisan of ordinary skill recognizes that departures from the disclosed embodiments may be made within the scope of the invention and that obvious modifications will occur to a person skilled in the art. Those of ordinary skill in the art should, in light of the present disclosure, appreciate that many changes can be made in the specific embodiments which are disclosed herein and still obtain a like or similar result without departing from the spirit and scope of the invention. All of the embodiments disclosed and claimed herein can be made without undue experimentation in light of the present disclosure.

We claim:

1. A combination tweezer apparatus comprising:

a pair of prongs together defining a hair grasping first end and joined second end;

a light source, adjacent the joined second end, which projects light toward the hair grasping first end;

a flexible extended member comprising a third end engaged with the joined second end and a fourth end; and a body engaged with the fourth end and comprising a magnifying mirror.

2. The apparatus of claim 1; wherein the body further comprises a receiving area for at least a major portion of the flexible extended member.

3. The apparatus of claim 2, wherein the receiving area is disposed along the periphery of the body.

4. The apparatus of claim 3, wherein the receiving area is a channel or groove.

5. The apparatus of claim 1; wherein the body further comprises a retainer that retains the pair of prongs adjacent to the body.

6. The apparatus of claim 5, wherein the retainer engages the joined second end.

7. The apparatus of claim 1, wherein the light source is operationally engaged with the body.

8. The apparatus of claim 7, wherein the body further comprises an electrical source.

9. The apparatus of claim 7, wherein the body further comprises a switch to activate the light source.

10. The apparatus of claim 1 further comprising a cover for the pair of prongs.

11. The apparatus of claim 10, wherein the body further comprises a retainer that engages the cover or the joined second end.

12. The apparatus of claim 1 further comprising a retraction mechanism in the body to make the flexible extended member retractable with respect to the body.

13. A device for removing hair comprising, in a single unit:

a tweezers comprising a hair grasping end and a joined end;

a light source engaged with the tweezers to project light toward the hair grasping end;

a flexible extended member engaged with the tweezers;

a body engaged with the flexible extended member; and a magnifying mirror engaged with the body.

14. The device of claim 13, wherein the body further comprises a retainer for the tweezers.

15. The device of claim 13, wherein the body further comprises a receiving area for the flexible extended member.

16. The device of claim 13, wherein the body is operationally engaged with the light source.

17. The device of claim 16, wherein the body further comprises a source of electricity.

18. The device of claim 13 further comprising a cover for the tweezers.

19. The device of claim 13 further comprising a retraction mechanism in the body to make the flexible extended member and tweezers retractable with respect to the body.

20. A hair removal device comprising in a single unit:

a tweezers;

a light source engaged with the tweezers;

a flexible extended member engaged with the tweezers;

a body engaged with the flexible extended member and comprising a receiving area for the flexible extended member, a retainer for the tweezers, and a magnifying mirror.

21. The device of claim 20, wherein the body is operationally engaged with the light source.

22. The device of claim 21, wherein the body further comprises an electrical source.

23. The device of claim 20 further comprising a retraction mechanism in the body to make the flexible extended member and tweezers retractable with respect to the body.

24. A kit for removal of hair comprising:

illuminated tweezers for removing hair;

a compact comprising a lid and a body, a receptacle for the tweezers, a light source other than the light source of the illuninated tweezers, and one or more other receptacles; and two or more interchangeable mirrors, each mirror having a different magnification level, wherein at least one of the two or more mirrors is removably attached to the lid;

wherein the kit further comprises a retraction mechanism in the compact to make the tweezers retractable with respect to the compact, wherein the retraction member is attached to the tweezers and the compact.

25. The kit of claim 24, wherein the compact further comprises one or more reservoirs of cosmetic and one or more cosmetic applicators.

26. The kit of claim 25, wherein the one or more reservoirs of cosmetic are permanent or replaceable with respect to the compact.

27. The kit of claim 24 wherein two of the two or more mirrors are disposed on opposite sides of the same substrate.

28. The kit of claim 24, wherein the two or more mirrors are on different substrates.

29. The kit of claim 24, wherein the light source of the compact is disposed adjacent at least one of the two or more mirrors or an optional reservoir of cosmetic.

* * * * *